US010673187B2

(12) United States Patent
Crevenat

(10) Patent No.: US 10,673,187 B2
(45) Date of Patent: Jun. 2, 2020

(54) INTEGRATED COMPONENT FOR PROTECTING AGAINST OVERVOLTAGES, IN PARTICULAR FOR A COAXIAL-CABLE SYSTEM

(71) Applicant: CITEL, Sevres (FR)

(72) Inventor: Vincent Crevenat, Pembroke Plains, FL (US)

(73) Assignee: CITEL, Sevres (FR)

( * ) Notice: Subject to any disclaimer, the term of this patent is extended or adjusted under 35 U.S.C. 154(b) by 0 days.

(21) Appl. No.: 16/475,791

(22) PCT Filed: Dec. 28, 2017

(86) PCT No.: PCT/FR2017/053859

§ 371 (c)(1),
(2) Date: Jul. 3, 2019

(87) PCT Pub. No.: WO2018/127650

PCT Pub. Date: Jul. 12, 2018

(65) Prior Publication Data

US 2019/0348804 A1 Nov. 14, 2019

(30) Foreign Application Priority Data

Jan. 6, 2017 (FR) ..... 17 50117

(51) Int. Cl.
*H01R 24/48* (2011.01)
*H01C 1/14* (2006.01)
(Continued)

(52) U.S. Cl.
CPC ..... *H01R 24/48* (2013.01); *H01C 1/14* (2013.01); *H01C 7/10* (2013.01); *H01T 1/16* (2013.01); *H01T 4/04* (2013.01); *H01R 2103/00* (2013.01)

(58) Field of Classification Search
CPC ..... H01R 24/48; H01R 2103/00; H01C 1/14; H01C 7/10; H01T 1/16; H01T 4/04
(Continued)

(56) References Cited

U.S. PATENT DOCUMENTS 5,751,534 A * 5/1998 DeBalko ..... H01Q 1/50 361/111
6,061,223 A * 5/2000 Jones ..... H01Q 1/1285 361/119
(Continued)

FOREIGN PATENT DOCUMENTS

EP 0893863 * 7/1996 ..... H01T 4/12
EP 1187290 A1 3/2002
(Continued)

OTHER PUBLICATIONS

International Search Report for corresponding PCT application No. PCT/FR2017/053859, dated Apr. 10, 2018.

*Primary Examiner* — Harshad C Patel
(74) *Attorney, Agent, or Firm* — Notaro, Michalos & Zaccaria P.C.

(57) ABSTRACT

An integrated component for protecting against overvoltages, including a varistor and a gas discharge tube that are connected in series between a first and a second electrical connection terminal and a peripheral coating including a seal-tight and electrically insulating resin, the peripheral coating being arranged around the varistor and the gas discharge tube so as to form a seal-tight and electrically insulating barrier that leaves the first and second electrical connection terminals accessible only at two opposite ends of the peripheral coating.

10 Claims, 3 Drawing Sheets

(51) Int. Cl.

| | |
|---|---|
| ***H01C 7/10*** | (2006.01) |
| ***H01T 1/16*** | (2006.01) |
| ***H01T 4/04*** | (2006.01) |
| *H01R 103/00* | (2006.01) |

(58) Field of Classification Search
USPC ..... 439/578; 361/117, 119, 120
See application file for complete search history.

(56) References Cited

U.S. PATENT DOCUMENTS

| | | | | |
|---|---|---|---|---|
| 6,636,407 | B1 * | 10/2003 | Ryman | H01P 1/202 361/113 |
| 8,174,132 | B2 * | 5/2012 | Van Swearingen | H01G 4/01 257/798 |
| 2002/0021541 | A1 * | 2/2002 | Kauffman | H01C 21/50 361/119 |
| 2009/0195956 | A1 * | 8/2009 | Harwath | H01R 24/48 361/119 |
| 2009/0207540 | A1 * | 8/2009 | Chen | H01R 13/652 361/56 |
| 2012/0188678 | A1 * | 7/2012 | Harwath | H01R 24/48 361/119 |
| 2016/0035529 | A1 * | 2/2016 | Durth | H01T 1/14 337/18 |

FOREIGN PATENT DOCUMENTS

| | | | |
|---|---|---|---|
| JP | 3002814 | B2 | 1/2000 |
| JP | 2002246141 | A | 8/2002 |

* cited by examiner

INTEGRATED COMPONENT FOR PROTECTING AGAINST OVERVOLTAGES, IN PARTICULAR FOR A COAXIAL-CABLE SYSTEM

TECHNICAL FIELD

The invention relates to the field of integrated components for protecting against overvoltages for electrical systems, in particular for a system for transmitting radiofrequency data by coaxial cable.

TECHNOLOGICAL BACKGROUND

In order to protect an electrical device, it is common practice to use, between the two lines of an AC mains, a metal oxide varistor, in particular a zinc oxide varistor, connected in series with a gas discharge tube.

Such a device theoretically operates in the following manner: the gas discharge tube withstands practically the entire AC voltage of the mains. Specifically, the stray capacitance of the discharge tube is of a few picofarads, while the stray capacitance of the varistor is of a few nanofarads. When an overvoltage occurs, the latter causes the gas discharge tube to trigger, the latter being able to be extinguished only if the current, termed secondary current, that passes through it subsequently becomes sufficiently small. It is the resistance of the varistor that ensures that the secondary current is limited and enables the gas discharge tube to be extinguished.

However, protection devices combining varistors and discharge tubes are large and bulky.

SUMMARY OF THE INVENTION

One idea underlying the invention is that of combining the two functions of varistor and gas discharge tube to form a single integrated discrete component therefrom that is able to protect an electrical device. Another idea underlying the invention is that of producing a miniaturized component.

There are many devices that are able to be protected by the integrated component. For example, systems for transmitting data and/or power by coaxial cable, electronic equipment, telephone and computer systems, photovoltaic equipment, LED lighting equipment, etc.

One of the advantages of the invention is that of facilitating the installation of the two functions on an item of equipment to be protected against transient overvoltages.

To this end, the invention provides an integrated component for protecting against transient overvoltages, including:

a varistor and a gas discharge tube that are connected in series between a first and a second electrical connection terminal;

and a peripheral coating including a seal-tight and electrically insulating resin, the peripheral coating being arranged around the varistor and the gas discharge tube so as to form a seal-tight and electrically insulating barrier that leaves the first and second electrical connection terminals accessible only at two opposite ends of the peripheral coating.

According to some embodiments, such an integrated component may include one or more of the following features.

In one embodiment, the gas discharge tube is cylindrical in shape, the varistor is cylindrical in shape and is arranged coaxially with the gas discharge tube and the shape of the peripheral coating is externally cylindrical and coaxial with the gas discharge tube and the varistor.

The section of the peripheral coating may take one of various shapes, for example it may be rectangular, square, circular, oval or polygonal in shape. In some embodiments, the section of the peripheral coating is circular, rectangular or square in shape. Thus, the integrated component may take various external shapes, for example a cylindrical shape with a circular section, a cylindrical shape with a rectangular section or a cylindrical shape with a square section.

The electrical connection terminals may be produced in various forms, from conductive metal. In some embodiments, the electrical connection terminals take the form of conductive pins or of conductive plates.

In one embodiment, the gas discharge tube includes a first discharge-tube electrode, a second discharge-tube electrode and a discharge-tube body that is positioned between the first and the second discharge-tube electrodes, the body of the discharge tube being cylindrical with a circular section, the first and the second discharge-tube electrodes being two parallel conductive plates having the same section as the discharge-tube body.

In one embodiment, the varistor includes a varistor body made of metal oxide, a first varistor electrode and a second varistor electrode being placed on either side of the varistor body, the varistor electrodes being made metal plates.

According to one embodiment, the varistor is a zinc oxide (ZnO) varistor. According to one embodiment, the varistor is a multilayer varistor.

According to one embodiment, the varistor consists of two elementary varistors that are arranged in parallel. Arranging a plurality of elementary varistors in parallel makes it possible to increase the capacity to withstand pulsed currents without increasing the diameter of the varistors, which affords an advantage in terms of miniaturization.

The varistor may have various dimensions, for example of the order of 5×5×5 mm. These dimensions are particularly suited to a component placed on a board. The thickness of the varistor may be selected according to the maximum nominal (rated) operating voltage. This nominal operating voltage may vary from a few tens of volts to several hundred volts.

In one embodiment, one discharge-tube electrode and one varistor electrode are fastened parallel to each other and in electrical contact with each other by a metal solder joint. Alternatively, an intermediate element, for example a metal plate, may be used to make the electrical connection between the gas discharge tube and the varistor.

In one embodiment, the seal-tight and electrically insulating resin is an epoxy resin.

The invention also provides a terminal connector for a coaxial cable, including a peripheral conductive portion that is intended to be connected to the shielding of a coaxial cable and a central conductive portion that is intended to be connected to the core conductor of a coaxial cable, wherein the aforementioned integrated protection component is arranged electrically between the peripheral conductive portion of the terminal connector and the central conductive portion of the terminal connector, the two connection terminals of the integrated protection component making electrical contact with the peripheral conductive portion and the central conductive portion of the terminal connector, respectively.

In some embodiments, the terminal connector may be embodied as a standardized type chosen from the list consisting of KS, BNC, TNC, N and 7/16 connectors.

Such a terminal connector may be produced in the form of a male connector or a female connector.

According to one embodiment, the invention also provides a system for transmitting radiofrequency data by coaxial cable including the aforementioned terminal connector for making a connection between two sections of coaxial cable.

BRIEF DESCRIPTION OF THE FIGURES

The invention will be better understood and other aims, details, features and advantages thereof will become more clearly apparent over the course of the following description of several particular embodiments of the invention, which are given solely by way of nonlimiting illustration, with reference to the appended drawings.

In these drawings.

DETAILED DESCRIPTION OF THE INVENTION

A protection component 1 intended to be mounted in an electrical system and making it possible to protect the electrical system against overvoltages will now be presented with reference to the FIGS. 1 to 4.

Figure 1:
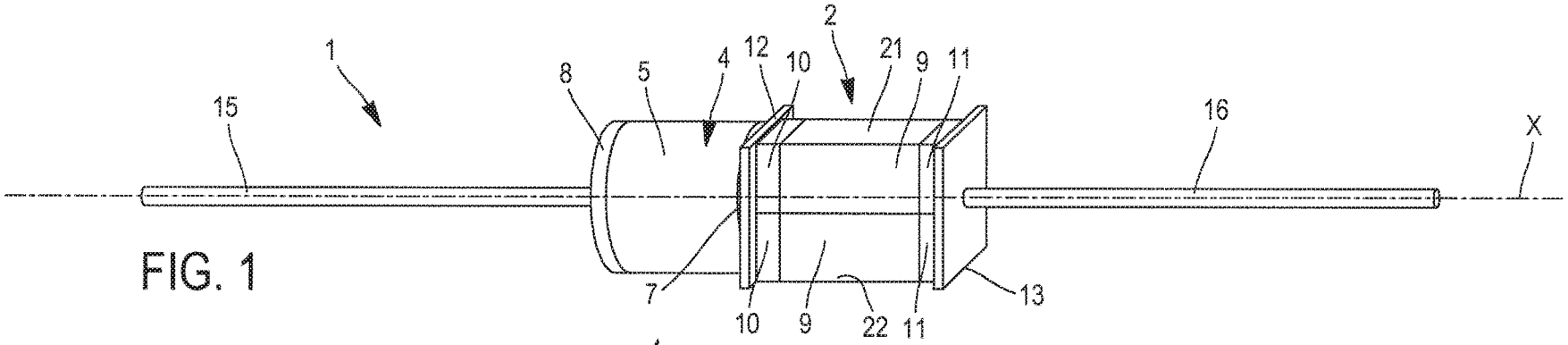
FIG. 1 is a perspective view of an electrical protection component according to a first embodiment, when it is not coated.
Figure 2:
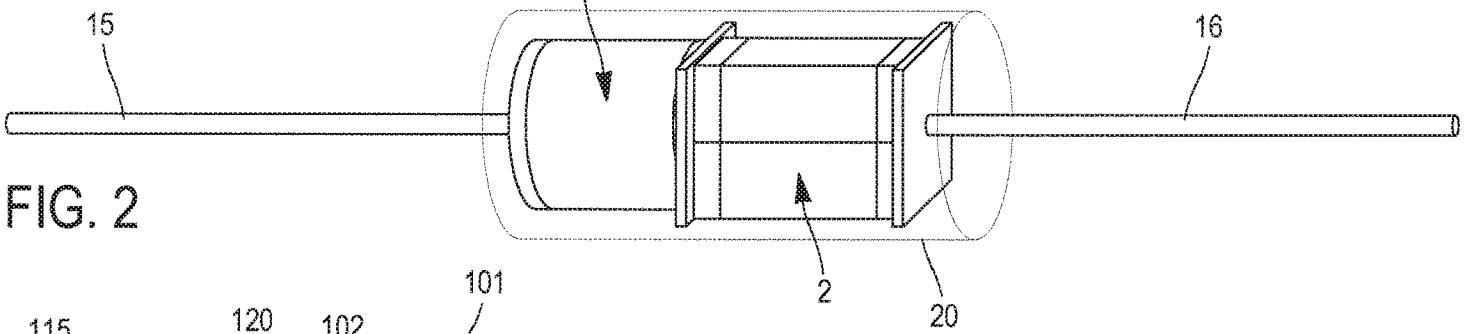
FIG. 2 is a view of the electrical protection component of FIG. 1, when it is coated.
Figure 3:
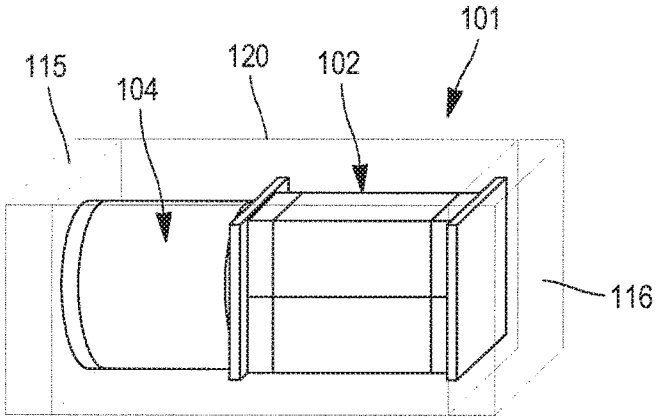
FIG. 3 is a perspective view of an integrated electrical protection component according to a second embodiment.
Figure 4:
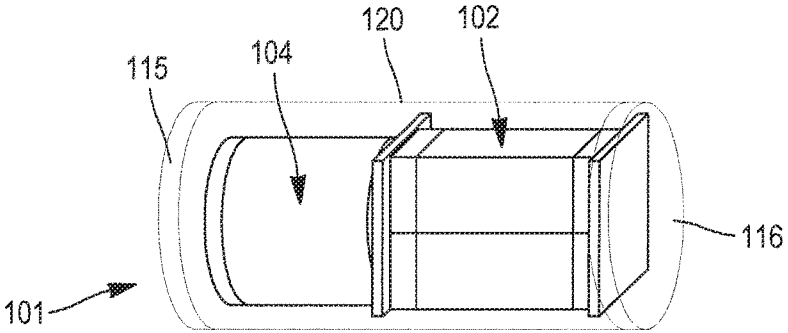
FIG. 4 is a perspective view of an integrated electrical protection component according to a third embodiment.

Three embodiments of the protection component 1 will be presented. The first embodiment is shown in FIGS. 1 and 2. The second embodiment is shown in FIG. 3. The third embodiment is shown in FIG. 4.

FIG. 1 shows a protection component 1 incorporating a gas discharge tube 4 and a varistor 2 that are connected in series.

The varistor 2 preferably includes two elementary varistors 21 and 22 in the shape of parallelepipedal rectangles connected in parallel. Each elementary varistor 21, 22 includes a multilayer varistor structure 9 based on zinc oxide and two planar, rectangular electrodes 10 and 11 that are placed on either side of the multilayer varistor structure 9. The multilayer varistor structure 9 of the elementary varistors 21 and 22 is a parallelepipedal rectangle. The electrodes 10 and 11 are the same size as the section of the multilayer varistor structure 9 and are positioned at two longitudinal ends thereof.

The electrodes 10 and 11 each include an inner surface making contact with the multilayer varistor structure 9 and an outer surface that is oriented toward the outside of the multilayer varistor structure 9.

The two elementary varistors 21 and 22 are positioned against one another via one side of the multilayer varistor structures 9 that is perpendicular to the electrodes 10 and 11. Thus, the electrodes 10 of the two elementary varistors 21 and 22 are positioned in one and the same plane, as are the electrodes 11.

Optionally, to facilitate the handling of the varistor 2, the varistor 2 includes two planar, rectangular electrodes 12 and 13, each having an inner surface and an outer surface. The rectangular electrodes 12 and 13 have areas that are twice that of the electrodes 10 and 11. The outer surfaces of the electrodes 10 of the elementary varistors 21 and 22 are attached to the inner surface of the electrode 12. The outer surfaces of the electrodes 11 of the elementary varistors 21 and 22 are attached to the inner surface of the electrode 13. Alternatively, the rectangular electrodes 12 and 13 may be omitted.

The gas discharge tube 4 is also referred to by the acronym GDT. The gas discharge tube 4 includes two electrodes 7 and 8 and a discharge-tube body 5 in the shape of a cylinder with axis X made of an insulating material, for example ceramic.

The electrodes 7 and 8 of the gas discharge tube 4 are planar, circular electrodes that are arranged on either side of the discharge-tube body 5, perpendicularly to the axis X of the cylinder. The diameter of the electrodes 7 and 8 is equal to that of the discharge-tube body 5.

The electrode 7 of the gas discharge tube 4 is positioned on the outer surface of the electrode 12 of the varistor 2. Thus, the electrodes 10 of the varistors 21 and 22 make electrical contact with the electrode 7 via the electrode 12, or directly if the latter is omitted.

All of the electrodes 7, 8, 10, 11, 12 and 13 are metal plates positioned in planes that are perpendicular to the axis X.

The protection component 1 also includes two connection pins 15 and 16. The connection pin 15 is attached to the electrode 8 and the connection pin 16 is attached to the outer surface of the electrode 13.

Lastly, to protect the protection component 1 thus obtained, it is advantageous to cover the assembly of the varistor 2 and the gas discharge 4 with a resin coating 20 such as shown in FIG. 2.

The resin coating 20 is a cylindrical coating with axis X. For example, the protective resin includes an epoxy resin. The resin coating 20 is arranged around the varistor 2 and the discharge tube so as to form an electrically insulating protective barrier. Only one end of the connection pins 15 and 16 protrudes from the resin coating 20 for connection to an electrical system.

Preferably, the protection component 1 has smaller dimensions, for example 5.5×11 mm. To this end, the gas discharge tube 4 is for example a gas discharge tube with reference BA, DB, BH or BG marketed by the applicant company.

By virtue of these characteristics, the component 1 may be used as a surge protector on an electrical circuit, a circuit board, a printed circuit board or in an electrical appliance simply by electrically connecting each of the connection pins 15 and 16.

The manufacture of the protection component 1 is straightforward and may be mechanized; the protection component 1 may be mass produced. The manufacture of the protection component 1 includes in particular the following steps:

Stacking the various constituent elements of the component within a mould (graphite plate with holes having the diameter of the assembled component minus resin).

The elements are the electrodes 12 and 13 (if present), solder preforms (tin alloy between each part to be assembled), the gas discharge tube 4 and the elementary varistors 21 and 22.

Heating in the reflow oven, using a system for holding the components, such as a vibrating plate or springs, so as to guarantee the dimensions.

Cooling.

Visual check.

Soldering of the connection pins 15 and 16 (optional).

Overmoulding of the resin coating 20.

Marking.

Two variants of the protection component 101 are shown in FIGS. 3 and 4. Those elements which are analogous or identical to those of FIGS. 1 and 2 bear the same reference number plus 100.

In the variant of FIG. 3, the resin coating 120 externally takes the shape of a cylinder with a square section and electrical contacts in the form of metal plates 116 and 115 replace the connection pins 15 and 16. The embodiment of FIG. 4 is similar, but with a circular section.

Figure 6:
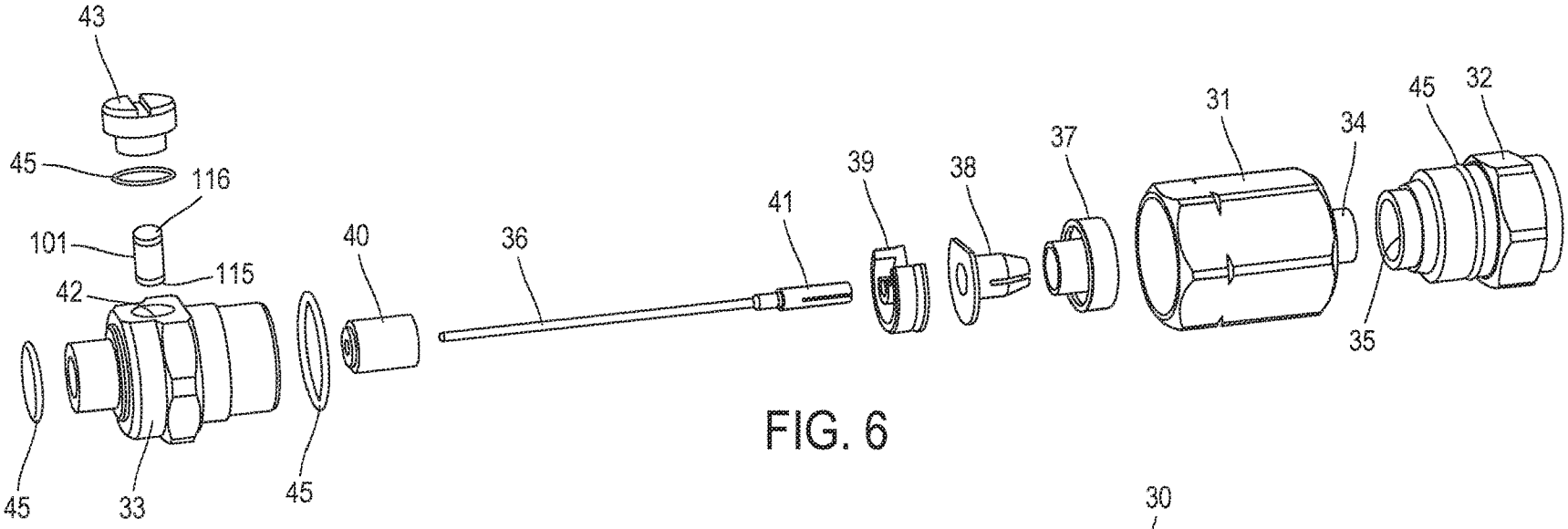
FIG. 6 is an exploded perspective view of the terminal connector for a coaxial cable of FIG. 5.
Figure 5:
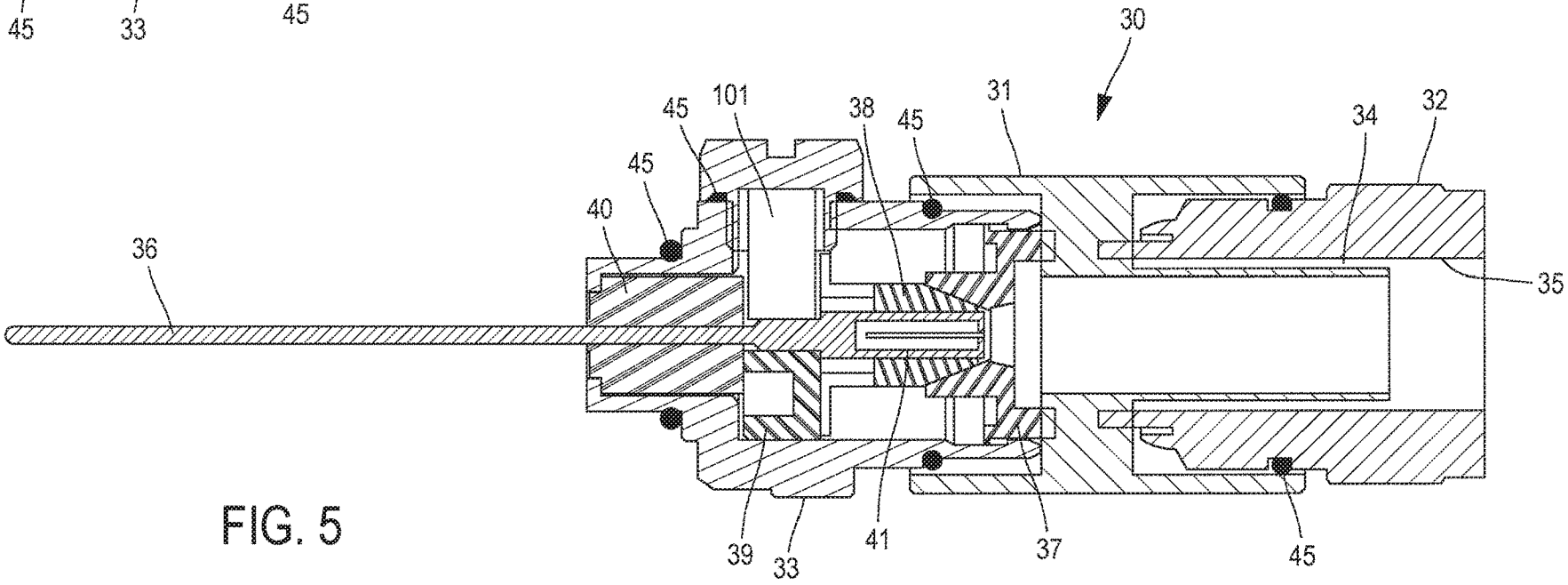
FIG. 5 is a longitudinal sectional view of a terminal connector for a coaxial cable in which integrated electrical protection components may be used.

With reference to FIGS. 5 and 6, a use of the protection component 101 in a terminal connector for a coaxial cable 30 is now described. More particularly, the protection component is arranged electrically between a peripheral conductive portion of the terminal connector, which is intended to be connected to the shielding of a coaxial cable, and a central conductor portion of the terminal connector, which is intended to be connected to the core conductor of the coaxial cable.

In FIGS. 5 and 6, the terminal connector 30 for a coaxial cable is a standardized KS connector. However, a similar arrangement of the protection component may be achieved in connectors of different types, for example BNC, TNC, N, 7/16, etc. types.

The terminal connector 30 is a male connector including a peripheral conductive portion that is intended to be connected to the shielding of a coaxial cable (not shown) and a central conductor portion that is intended to be connected to the core conductor of a coaxial cable.

The peripheral conductive portion consists of three metal nuts that are screwed to one another, made for example of aluminum or of steel: a median nut 31, a cable-side nut 32 and a terminal nut 33. The median nut 31 has a tubular sleeve 34 which extends in the direction of the cable-side nut 32 into a central bore 35 thereof. In use, the end of the shielding of the coaxial cable is housed in the annular space between the outer surface of the tubular sleeve 34 and the inner surface of the central bore 35 such that it makes electrical contact with them both. The end of the core conductor and of the dielectric sheath of the coaxial cable is fitted into the tubular sleeve 34.

A contact rod 36, for example made of copper or silvered copper, is fitted into the terminal nut 33 by means of a plurality of support parts made of insulating material 37 to 40, for example made of plastic material. In use, the end of the core conductor of the coaxial cable is fitted into a sleeve 41 at the end of the contact rod 36 so as to make electrical contact therewith. The dielectric sheath of the coaxial cable is interrupted upstream of the contact rod 36, for example against the support part 37.

The protection component 101 is housed in a transverse bore 42 of the terminal nut 33 and held therein by means of a screw plug 43, which is also made of metal. Thus, one end of the protection component 101 makes electrical contact against a lateral surface of the contact rod 36 while the other end of the protection component 101 makes electrical contact against the screw plug 43, which makes an electrical connection with the terminal nut 33.

Since the terminal connector 30 is intended to be used in a coaxial-cable network which may be positioned outside, in particular for a cable television network, O-rings 45 are arranged between the various screwed elements.

The terminal connector 30 is a male connector that is capable of being inserted into an associated female connector (FIG. 7) so as to provide an electrical connection between the contact rod 36 and a central conductor of the female connector and between the terminal nut 33 and a peripheral conductor of the female connector, respectively. Alternatively, the protection component 101 could be arranged within the female connector.

In the terminal connector 30, the protection component 101 is the sole electrical circuit connecting the peripheral conductive portion to the central conductive portion. The protection component 101 is preferably arranged with the gas discharge tube on the peripheral-conductive-portion side and the varistor on the central-conductive-portion side. This arrangement makes it possible to minimize the effect of the individual properties of the gas discharge tube (ceramic, filling gas and thin shell), which require a certain degree of statistical dispersion. This results in improved control of the total impedance of the assembly.

The terminal connector 30 may be used in any coaxial-cable transmission system, in particular in a data and power distribution system, in which the power is delivered in the form of a DC or AC voltage and the data are delivered in the form of a high-frequency, for example of the order of 1 MHz to 100 GHz, modulation.

Figure 7:
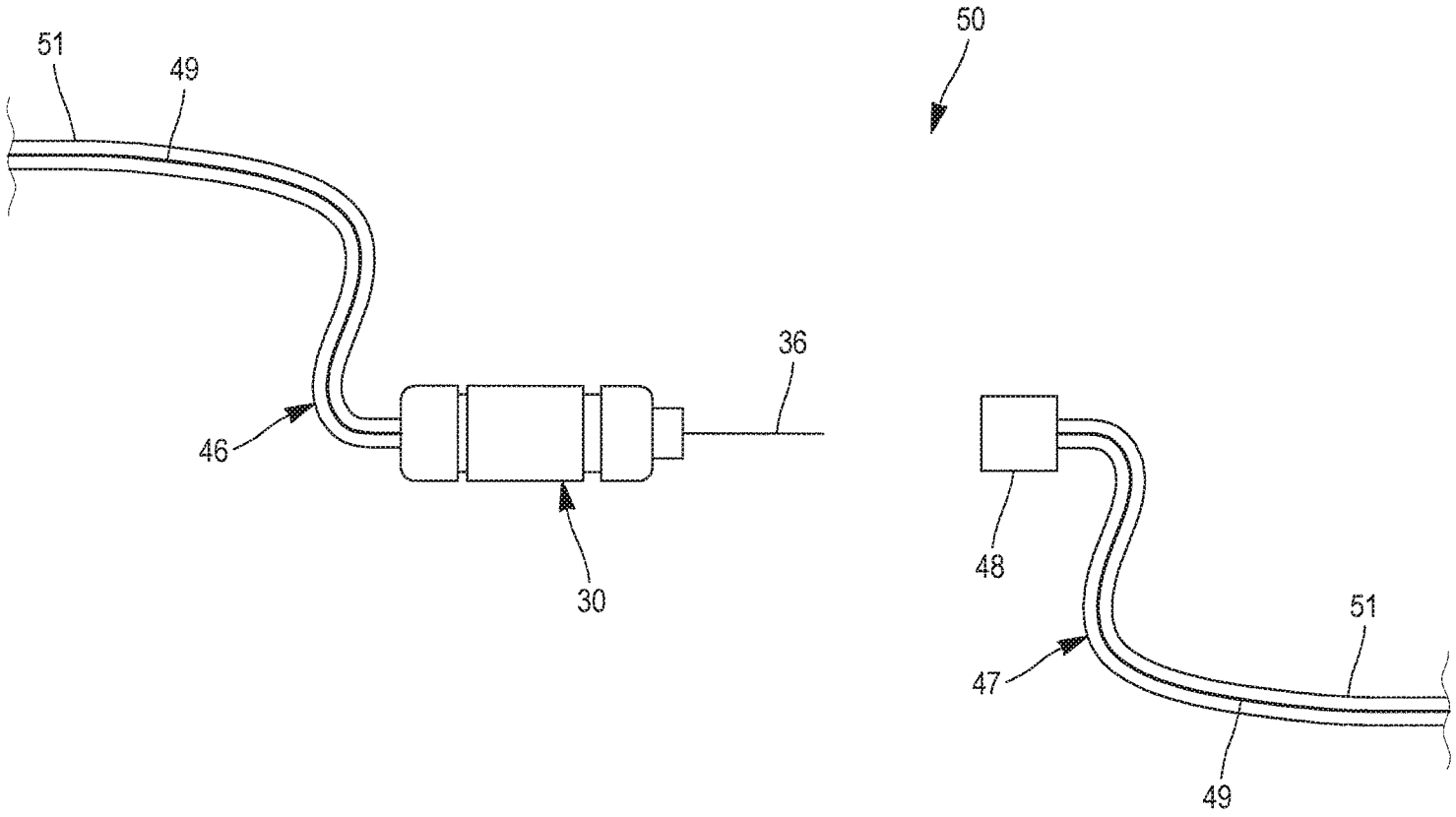
FIG. 7 is a schematic representation of a coaxial-cable distribution system in which the terminal connector of FIGS. 5 and 6 is used.

FIG. 7 partially shows a coaxial-cable transmission system 50. A first section of coaxial cable 46 has a first end terminating in the male terminal connector 30. A second section of coaxial cable 47 has one end terminating in a female terminal connector 48 that can be connected to the terminal connector 30. Each section of coaxial cable 46 and 47 includes a core conductor 49, peripheral shielding 51 and a dielectric insulator arranged between them. According to one embodiment, the peripheral shielding 51 is a semi-rigid metal tube.

In operation, in the event of a transient overvoltage, for example caused by lightning, the protection component 101 allows the discharge induced in the core conductor of the coaxial cable to be shunted into the peripheral shielding acting as a ground circuit, such that the overvoltage does not reach sensitive components of the transmission system. The overvoltage triggers the gas discharge tube. The gas discharge tube transitions from a state of very high impedance to a near-shorted state when a voltage that is higher than its trigger voltage is applied.

Numerical Example

In one embodiment suitable for a system for distributing data and power via coaxial cable, the gas discharge tube and the varistor are sized according to the following parameters:

Elementary varistor (each):

Imax: 4.5 kA (8/20 μs) (twice)

Uc: 65 V

Gas discharge tube (reference BA120 by CITEL):

Static trigger min: 120 V

Imax: 25 kA (8/20 μs) (once)

In: 10 kA (8/20 μs)

Resulting protection component:

Imax: 10 kA (8/20 μs) (improved mechanical hold)

In: 8 kA (8/20 μs) (15 times)

Uc: 90 V

Protection level: <280 V

Short-circuit current: 30 A

Although the invention has been described in connection with several particular embodiments, it is readily obvious that it is in no way limited thereto, and that it comprises all of the technical equivalents of the means described, and also combinations thereof if these fall within the scope of the invention.

The use of the verb "have", "comprise" or "include", and of its conjugated forms, does not exclude elements or steps other than those mentioned in a claim from being present. The use of the indefinite article "a" or "an" for an element or a step does not exclude a plurality of such elements or steps from being present, unless indicated otherwise.

In the claims, any reference sign between parentheses should not be interpreted as a limitation of the claim.

The invention claimed is:

1. An integrated component (1, 101) for protecting against overvoltages, including:

two multilayer elementary varistors (2, 102) that are arranged in parallel and that each include first and second varistor electrodes, the varistor electrodes being metal plates (10, 11);

and a gas discharge tube (4, 104) including first and second discharge-tube electrodes, the discharge-tube electrodes being conductive plates (7, 8), the two varistors (2, 102) and the gas discharge tube (4, 104) being connected in series between a first and a second electrical connection terminal (15, 16; 115, 116), and a peripheral coating (20, 120) including a seal-tight and electrically insulating resin, the peripheral coating being arranged around the varistor and the gas discharge tube so as to form a seal-tight and electrically insulating barrier that leaves the first and second electrical connection terminals accessible only at two opposite ends of the peripheral coating, wherein one of the discharge-tube electrodes (7) and one of the varistor electrodes (10) are fastened parallel to each other and in electrical contact with each other by a metal solder joint.

2. The integrated component as claimed in claim 1, wherein the gas discharge tube (4, 104) is cylindrical in shape, the varistors (2, 102) are cylindrical in shape and are arranged coaxially with the gas discharge tube and the shape of the peripheral coating (20) is externally cylindrical and coaxial with the gas discharge tube and the varistor.

3. The integrated component as claimed in claim 2, wherein the shape of the peripheral coating is circular in section.

4. The integrated component as claimed in claim 2, wherein the shape of the peripheral coating is rectangular or square in section.

5. The integrated component as claimed in claim 1, wherein the electrical connection terminals take the form of conductive pins (15, 16).

6. The integrated component as claimed in claim 1, wherein the electrical connection terminals take the form of conductive plates (115, 116).

7. The integrated component as claimed in claim 1, wherein the gas discharge tube (4, 104) includes a discharge-tube body (5) that is positioned between the first and the second discharge-tube electrodes, the body of the discharge tube (5) being cylindrical with a circular section, the first and the second discharge-tube electrodes being two parallel conductive plates (7, 8) having the same section as the discharge-tube body.

8. The integrated component as claimed in claim 1, wherein the varistor includes a varistor body (9) made of metal oxide, the first varistor electrode and the second varistor electrode being placed on either side of the varistor body.

9. Integrated protection component as claimed in claim 1, wherein the seal-tight and electrically insulating resin is an epoxy resin.

10. A terminal connector (30) for a coaxial cable, including a peripheral conductive portion (31, 32, 33) that is intended to be connected to the shielding of a coaxial cable and a central conductive portion (36) that is intended to be connected to the core conductor of a coaxial cable, wherein an integrated protection component (101) as claimed in claim 1 is arranged electrically between the peripheral conductive portion of the terminal connector and the central conductive portion of the terminal connector, the two connection terminals (115, 116) of the integrated protection component making electrical contact with the peripheral conductive portion and the central conductive portion of the terminal connector, respectively.

* * * * *